United States Patent [19]

Wojcik

[11] Patent Number: 4,920,633

[45] Date of Patent: May 1, 1990

[54] METHOD OF MANUFACTURING COMMUTATOR ASSEMBLIES

[75] Inventor: Thaddeus Wojcik, Des Plaines, Ill.

[73] Assignee: Resinoid Engineering Corporation, Newark, Ohio

[21] Appl. No.: 169,124

[22] Filed: Mar. 9, 1988

Related U.S. Application Data

[63] Continuation of Ser. No. 855,393, Apr. 24, 1986, abandoned.

[51] Int. Cl.[5] ..... H01R 43/08

[52] U.S. Cl. ..... 29/597; 310/43; 310/234; 310/236

[58] Field of Search ..... 29/597; 310/234–236, 310/42, 43

[56] References Cited

U.S. PATENT DOCUMENTS 3,140,414 7/1964 Skjodt et al. ..... 29/597 X 3,376,443 4/1968 McColl ..... 29/597 X

*Primary Examiner*—Carl E. Hall

*Attorney, Agent, or Firm*—Wood, Dalton, Phillips, Mason & Rowe

[57] ABSTRACT

A commutator shell suitable for receiving a molded commutator core is fabricated by providing an elongated ribbon of electrically conductive material. The ribbon is passed through a set of rollers to form a plurality of relatively shallow preliminary grooves of a given width longitudinally on one side of the ribbon to partially displace the conductive material. The ribbon is passed through a subsequent set of rollers to form the preliminary grooves to a full depth and to completely displace the material to a width substantially equal to that of the preliminary grooves to form the predetermined pattern of grooves between adjacent ribs. The ribbon is passed through a further set of rollers to form valleys in the tops of the ribs and to divide the ribs into dove-tailed cross-sections overhanging adjacent grooves. A length of the rolled ribbon is severed and shaped into an annular form so that the rib and groove pattern is on the inside thereof for anchoring to a core of insulating material molded inside the annular groove.

11 Claims, 5 Drawing Sheets

FIG. 1
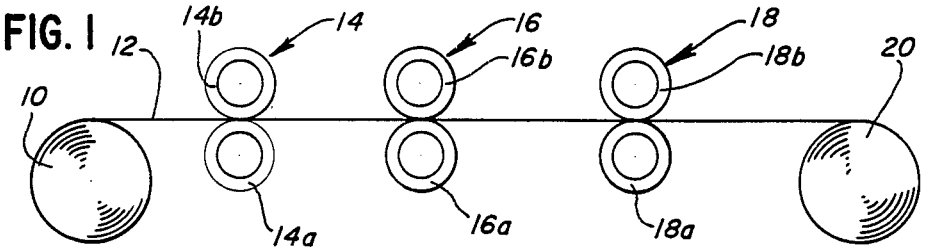
FIG. 2
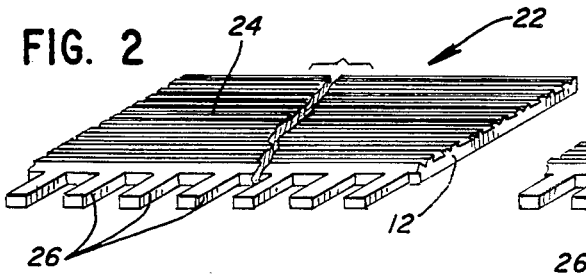
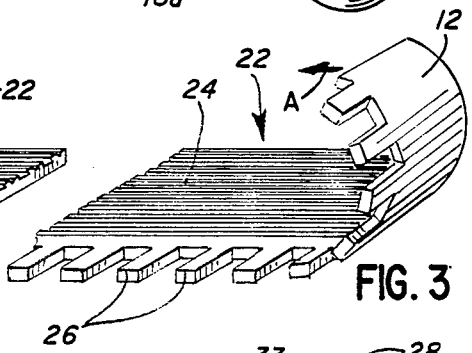
FIG. 3
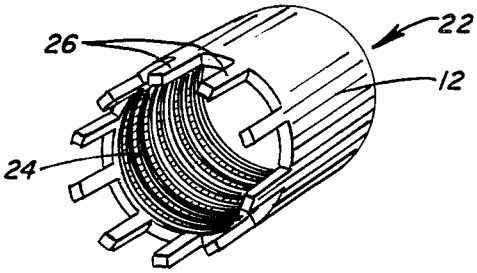
FIG. 4
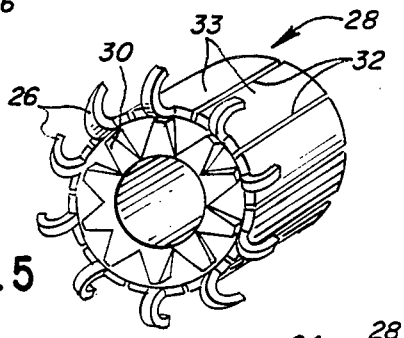
FIG. 5
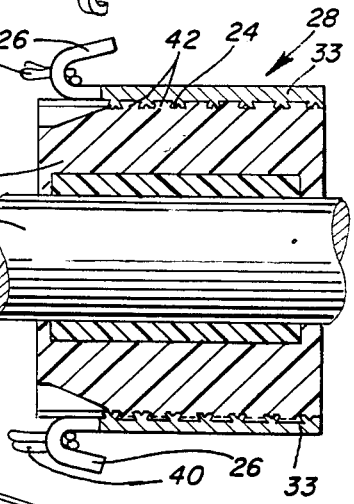
FIG. 7
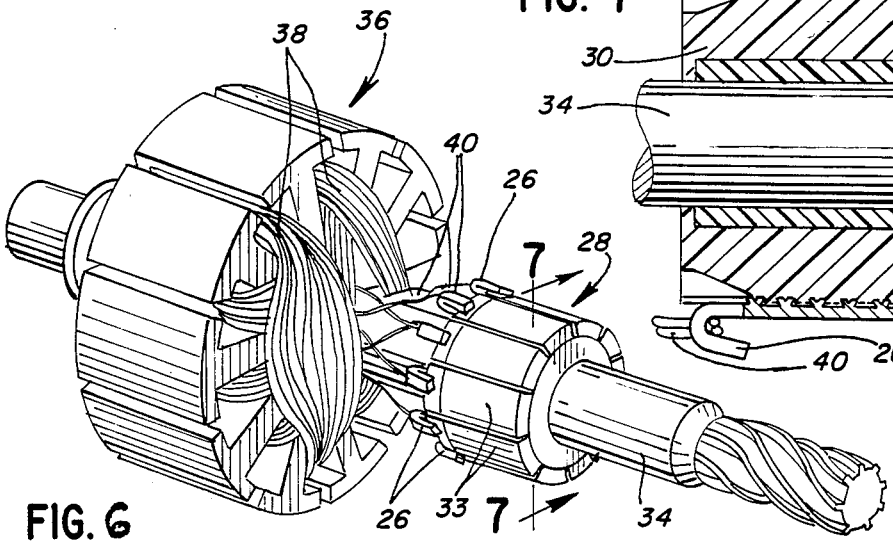
FIG. 6

FIG. 8
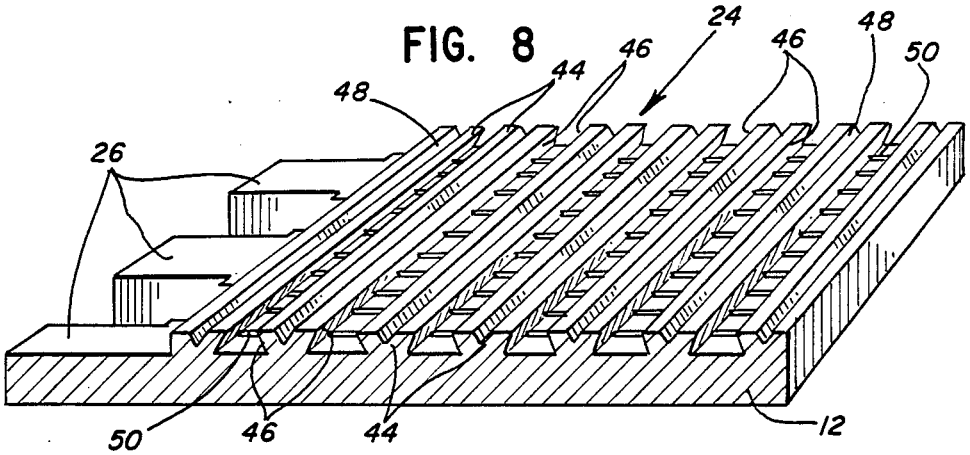
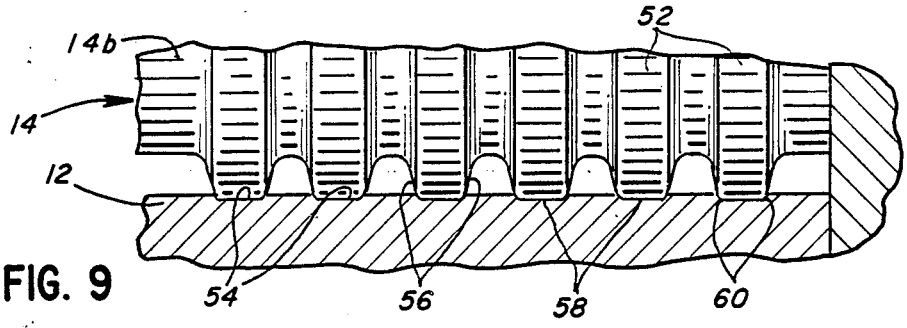
FIG. 9
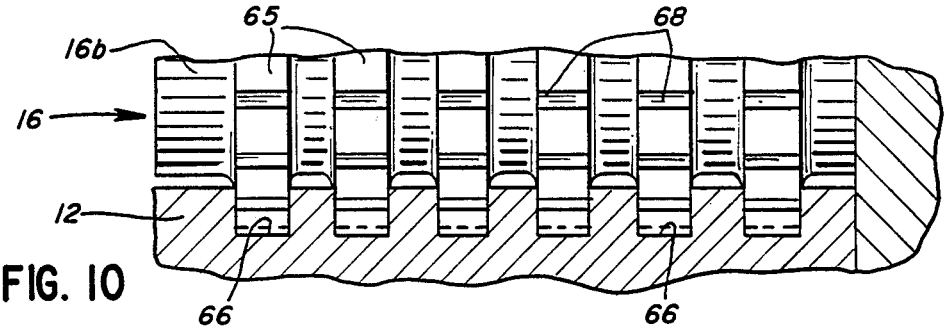
FIG. 10
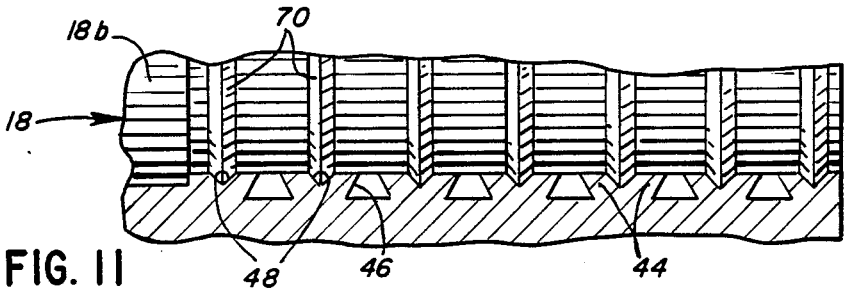
FIG. 11

METHOD OF MANUFACTURING COMMUTATOR ASSEMBLIES

This invention is a continuation of application Ser. No. 855,393, filed Apr. 24, 1986 now abandoned.

BACKGROUND OF THE INVENTION

This invention generally relates to current distribution devices and, more particularly, to molded commutator assemblies and a method of making same.

A conventional commutator assembly normally includes a core of insulating base material having a plurality of commutator segments disposed around the core. The commutator segments are separated from each other and extend longitudinally of the core and commutator assembly. Some form of locating or securing means, such as hooks, are provided at one end of the commutator segments for receiving and holding the coil ends of an appropriate motor armature in engagement with respective ones of the commutator segments for subsequent fusing to the segments. Small motor commutators typically are secured to armature shafts by means of a press interference fit.

One of the problems in designing and manufacturing commutator assemblies of the character described is that of providing an adequate bond between each commutator segment and the molded insulation material of the core without expensive manufacturing and assembly techniques. The bond is important to prevent the commutator segments from becoming loosened from the core which would result in an out-of-round condition wherein the outer surface of some of the segments are at a greater distance from the rotational axis than the remaining segments. This occurrence results in an increase in electrical and audible noise in the vicinity of the motor due to uneven brush contact with the commutator segments as the rotor is rotating. It also drastically reduces the life of the brushes, causing premature failure of the motor due to brush wear. An inadequate bond also could cause the commutator segments to be completely pulled off of the insulating core when the coil ends are secured to the hooks, for instance, during the assembly process by fabricating machines.

In an attempt to overcome the above problem, commutator assemblies have been designed wherein a plurality of tangs are formed in an inner surface of a tubular shell of electrically conductive material. The shell is bonded to an insulating core so that the core and the tangs are in interfering relationship. The shell then is slotted to form commutator bars or segments each having generally the same number of tangs independent of the number of bars cut from the shell. Such a commutator is disclosed in U.S. Pat. No. 2,658,159 to Herbst, dated Nov. 3, 1953 and assigned to the assignee of this invention.

Other patents disclosing commutator constructions are shown in U.S. Pat. No. 3,006,387 to C. A. Herbst, dated Dec. 4, 1962 and assigned to the assignee of this invention; and British Patent Specification No. 1,561,460 which was published Feb. 20, 1980.

Another approach to solving the problem of loosened commutator bars or segments is shown in U.S. Pat. No. 3,376,443 to McColl, dated Apr. 2, 1968. This patent shows a commutator assembly and method of making the assembly wherein a commutator shell is constructed from a flat ribbon or web of electrically conductive material, such as copper. The method of constructing the shell includes the steps of rolling one face of the web to form a plurality of longitudinal continuous dovetailed lands spaced from one another across the width of the ribbon or web, with a portion of each land overhanging an adjacent groove. The dovetailed configurations are formed by a series of steps which first form V-shaped grooves in the web and then flattening the tops of the resulting ribs between the grooves. A length of the rolled web then is severed and formed into a cylinder such that the longitudinal lands extend circumferentially on the inside of the web. A core is molded inside the resulting commutator shell so that the core material is disposed in the grooves between the dovetailed lands, and in particular so that a portion of the core material is trapped behind the overhanging portion of the lands. The shell is then slit lengthwise into a plurality of commutator segments or bars.

The McColl method has provided an improved bond between the commutator segments and the molded core because of the trapped core material behind the overhanging lands. However, the method of manufacturing the commutator shell, as described above, does not form a consistent dovetail configuration and has created severe problems in the integrity of the commutator shell and/or the commutator bars themselves. During the rolling process to form the dovetailed rib and groove pattern, considerable material, such as the copper, must be displaced. During displacement, fissures or "cracks" are formed in the commutator segments, normally at the bottom or base of the grooves that separate the dovetailed lands. As the brushes wear the outside of the commutator bars, the cracks actually can become exposed and create a current discontinuity as well as a rough surface which results in the aforesaid electrical or audible noise. These cracks contribute significantly to reducing the brush life of the motor.

In essence, it is important to provide an uninterrupted uniform thickness of electrically conductive material, such as the copper, along the area of the commutator bars. Prior attempts to provide a dovetailed rib and groove pattern have failed in this critical parameter.

This invention is directed to solving one or more of the above-identified problems.

SUMMARY OF THE INVENTION

An object, therefore, of the invention is to provide a new and improved commutator assembly of the character described, and a method of fabricating a commutator assembly.

In the exemplary embodiment of the invention, a commutator shell is formed with a rib and groove pattern on the inside surface of the shell for anchoring to a molded insulating commutator core. In fabricating the shell, an elongated ribbon of electrically conductive material is provided. A plurality of relatively shallow preliminary grooves of a given width are rolled longitudinally on one side of the ribbon by passing the ribbon through a first set of rollers to partially displace the conductive material. The preliminary grooves are rolled with generally converging tapered side walls, substantially flat bottom walls and rounded bottom corners.

The ribbon then is passed through a subsequent set of rollers to form the preliminary grooves to their full depth, and a width substantially equal to that of the preliminary grooves, to form the desired pattern of grooves between adjacent ribs.

The ribbon is passed through another set of rollers to form valleys in the tops of the ribs and to divide the ribs into dovetailed cross-sections overhanging the adjacent grooves. A plurality of spaced, upstanding ridges also may be rolled into the conductive material, the ridges spanning the bottom wall of each groove between adjacent ribs.

A length of the final rolled ribbon then is severed and shaped into an annular form so that the rib and groove pattern is on the inside thereof for anchoring to a core of insulating material molded inside the annular form.

Finally, axial slots are cut longitudinally of the annular form after the core is molded on the inside thereof to provide a plurality of commutator bars or segments.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a somewhat schematic side elevational view of a multiple-pass rolling apparatus for rolling one face of a ribbon or web of electrically conductive material to form the pattern of ribs and grooves described herein;

FIG. 2 is a fragmented side perspective view of a severed length of rolled ribbon prior to being formed into an annular form;

FIG. 3 is a view similar to that of FIG. 2, with the severed length of ribbon in the process of being annularly formed;

FIG. 4 is an end perspective view of the commutator shell completely formed into a cylinder;

FIG. 5 is an end perspective view of the commutator shell having the insulating core molded therewithin, the shell being slotted to form individual commutator segments, and with attachment hooks formed on the end of each segment;

FIG. 6 is a perspective view of a motor armature incorporating a commutator assembly according to the invention;

FIG. 7 is a longitudinal central section, on an enlarged scale, taken generally along line 7—7 of FIG. 6, through the commutator assembly;

FIG. 8 is an enlarged perspective view of a transverse section through the rolled ribbon of FIG. 2;

FIG. 9 is an elevation of the first-pass roller for forming the preliminary grooves in the ribbon;

FIG. 10 is an elevational view of a subsequent-pass roller for completely forming the groove pattern to full depth;

FIG. 11 is an elevational view of a furtherpass roller for forming the ribs into dovetailed configurations;

DETAILED DESCRIPTION OF THE PREFERRED EMBODIMENT

Figure 12:
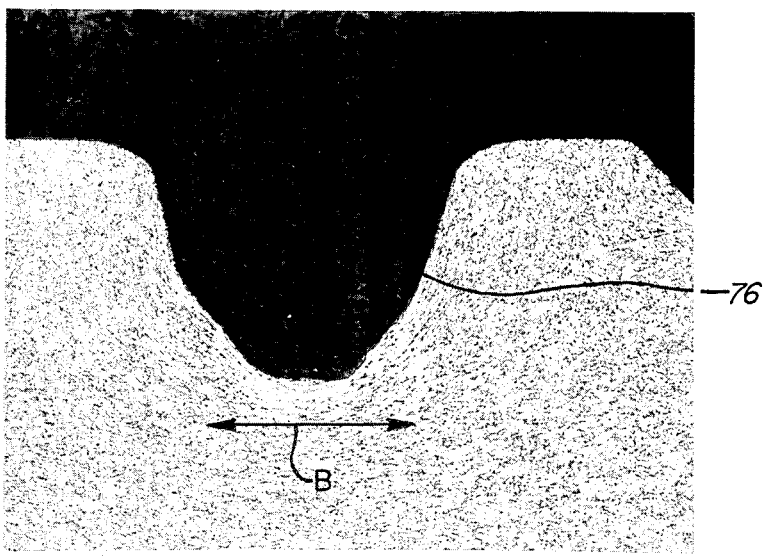
FIG. 12 (PRIOR ART)
FIGS. 12–14 are magnified photographs of a ribbon having been passed through a three-pass roller process of the prior art.

Referring to the drawings in greater detail, and first to FIG. 1, a multiple-pass rolling apparatus is illustrated somewhat schematically. A supply reel 10 feeds an elongated web or ribbon 12 of electrically conductive material, such as copper, through plural sets of rollers, generally designated 14,16 and 18, respectively. Conventionally, bottom rollers 14*a*, 16*a* and 18*a* comprise backup rollers having smooth cylindrical outer surfaces. Upper rollers 14*b*, 16*b* and 18*b* have circumferentially ribbed patterns for forming the rib and groove pattern on the top surface or side of ribbon 12. After forming the rib and groove pattern on one side of ribbon 12, the ribbon is wound onto a take-up reel 20 for further processing.

FIG. 2 shows the next fabrication step of severing a predetermined length, generally designated 22, from the rolled ribbon 12. The rolled rib and groove pattern can be seen on the top surface of ribbon 12, as at 24. An equally spaced series of arms 26 are cut to shape along one edge of ribbon length 22. This can be done by conventional means either before, after or simultaneously with severing the ribbon into the predetermined lengths. The arms ultimately are turned into hook-shapes for securing coil ends to the commutator assembly.

FIG. 3 illustrates the next fabrication step of turning length 22, as indicated by arrow "A", to shape the severed length into an annular form so that the rib and groove pattern 24 is on the inside thereof. FIG. 4 shows the severed length of rolled ribbon shaped into a complete cylinder of the precise dimensions for the commutator shell.

FIG. 5 shows a complete commutator, generally designated 28, wherein an insulating commutator core 30 has been molded on the inside of the commutator shell. It can be seen that arms 26 now have been turned into hook shapes, and that slots 32 have been cut longitudinally of the commutator shell, equidistant between hooks 26 to form individual commutator segments or bars 33 which are isolated from one another and bonded to core 30 by means of the rib and groove pattern 24.

FIG. 6 shows completed commutator assembly 28 press-fit onto an armature shaft 34 of a motor armature, generally designated 36. The motor armature includes windings 38 having coil ends 40 secured to hooks 26 of the armature assembly.

FIG. 7 shows an axial section through commutator assembly 28 mounted on armature shaft 34. The dovetailed configuration of the ribs of rib and groove pattern 24 can be seen with molded insulating material of core 30 trapped between the ribs, as at 42, for bonding commutator segments 33 securely to the core.

FIG. 8 is an enlarged perspective view to better illustrate the details of rib and groove pattern 24 rolled onto the upper surface or side of ribbon 12, as described in relation to FIG. 2. More particularly, a plurality of ribs 44 are separated by grooves 46. Each rib is spread by a valley 48 to create a dovetailed configuration whereby the ribs overhang adjacent grooves, as shown, to trap molded core material under the overhanging side walls of the ribs. Ridges 50 also are shown transversely spanning the bottom walls of grooves 46.

FIGS. 9–11 show upper rollers 14*b*, 16*b* and 18*b* of roller sets 14,16 and 18, respectively, in the process of forming the rib and groove pattern 24 on the top surface of ribbon 12, to the ultimate configuration as illustrated in FIG. 8.

More particularly, roller 14*b* of first-pass roller set 14 is shown in FIG. 9 and includes a plurality of axially spaced, circumferential ribs 52 which form a plurality of longitudinal, relatively shallow preliminary grooves 54 extending longitudinally of ribbon 12. Roller ribs 52 have convergingly tapered side walls 56 to form convergingly tapered side walls of preliminary grooves 54. Roller ribs 52 have substantially flat cylindrical outer surfaces 58 to form substantially flat bottom walls in the preliminary grooves 54. Roller ribs 52 further have rounded edges 60 to form rounded bottom corners of preliminary grooves 54. Details of the precise shape of preliminary grooves 54 can be seen in FIG. 15, as discussed hereinafter.

Roller 16*b* of subsequent-pass roller set 16 is shown in FIG. 10 and is effective to form preliminary grooves 54 to full depth grooves 66. The full depth grooves have a width substantially equal to that of preliminary grooves 54, for purposes described in relation to FIG. 15–16. Roller 16*b* has a plurality of axially spaced, circumferential ribs 65. These ribs form preliminary grooves 54 to their full depth. Roller ribs 65 also have transverse grooves 68 for forming ridges 50 in the bottom of grooves 66 (i.e. grooves 46 described in relation to FIG. 8).

Roller 18*b* of further-pass roller set 18 (FIG. 1) is illustrated in FIG. 11 and includes a plurality of equally spaced roller ribs 70 which are triangularly shaped to form valleys 48 (see also FIG. 8) and thereby spread ribs 44 into the dovetailed configurations shown, whereby the sides of commutator segment ribs 44 overhang grooves 46 to trap molded core material thereunder as described above.

Figure 13:
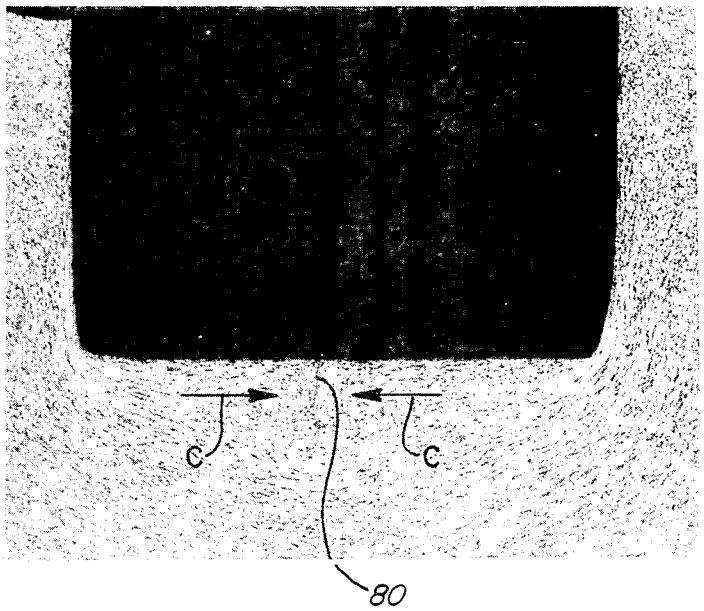
FIG. 13 (PRIOR ART)
Figure 14:
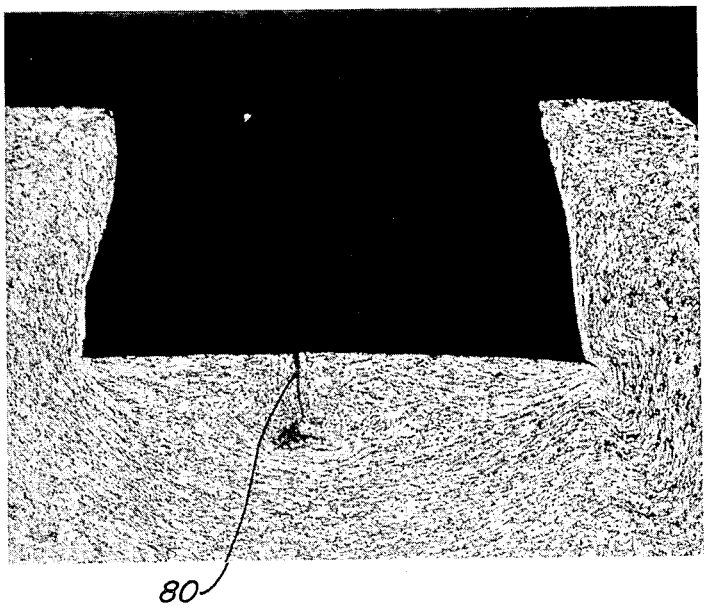
FIG. 14 (PRIOR ART)

FIGS. 12–14 show the manner in which a dovetailed rib and groove pattern heretofore has been formed by rolling apparatus in accordance with the prior art. These figures are actual photographs of 50-power magnification through a section of a commutator bar or segment fabricated according to prior art techniques. The ends of the commutator sections were etched and polished to enable visualization of the metallurgical alignment or arrangement of the material.

Specifically, according to prior art techniques, a relatively deep, rounded preliminary groove 76 is rolled into a web or ribbon of electrically conductive material, such as copper, as actually shown in FIG. 12. This is done in a first-pass set of rollers. The second pass is shown in FIG. 13 wherein the groove which forms the full depth of the desired rib and groove pattern has been made by sort of superimposing the second rolling pass over the first rolling pass. The problem with such techniques is that an exhorbitant amount of material was displaced laterally, as indicated by double-headed arrow B in FIG. 12. When the second pass of FIG. 13 is performed, it is believed that a considerable amount of this outwardly displaced material is forced back inwardly in the direction of arrows "C" (FIG. 13) which results in the creation of fissures or "cracks" 80 as clearly seen in the actual, highly magnified photograph of FIG. 13. The tops of the ribs then are flattened as seen in FIG. 14 to form dovetailed configurations. This is similar to the McColl process described in the background discussion, above. When the ribs of the rib and groove pattern are shaped into dovetailed configurations, fissures or "cracks" 80 remain and a defective commutator bar results. The defective commutator bar shown in FIGS. 13 and 14 is not an isolated occurrence and practically always results. The fissures may weaken the bond of the commutator bars and can cause the commutator segments to be pulled off of the insulating core. The weakened bars can cause an out-of-round condition of the commutator which drastically reduces brush life of the motor. Should the cracks eventually become exposed, a rough surface results which significantly reduces brush life. Furthermore, by forming the dovetailed configurations by flattening the ribs after the grooves are formed, inconsistency results in the dovetail cross-section along the ribs.

Figure 15:
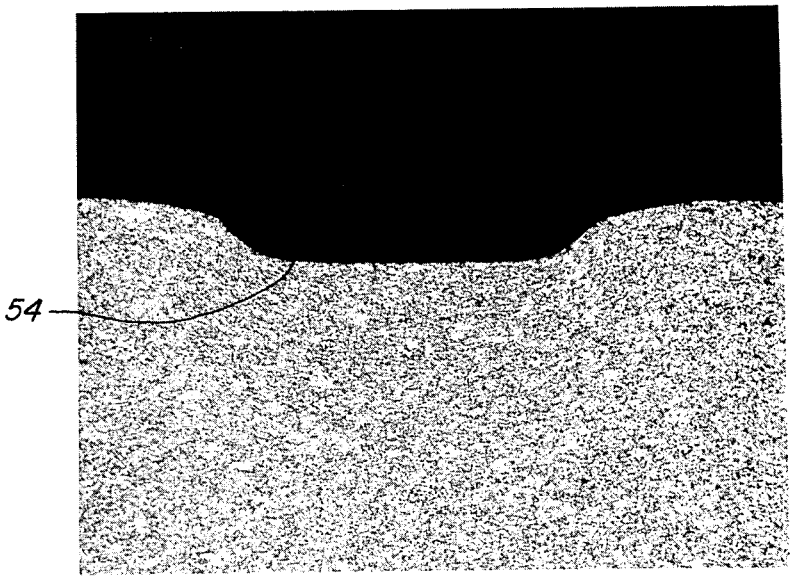
FIGS. 15–17 are magnified photographs of a ribbon having been passed through a multiple-pass roller process of the invention.
Figure 16:
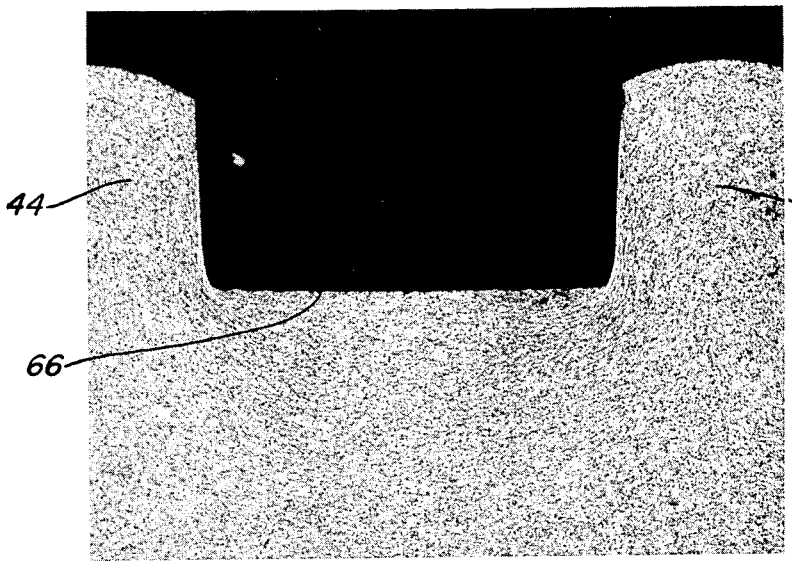
Figure 17:
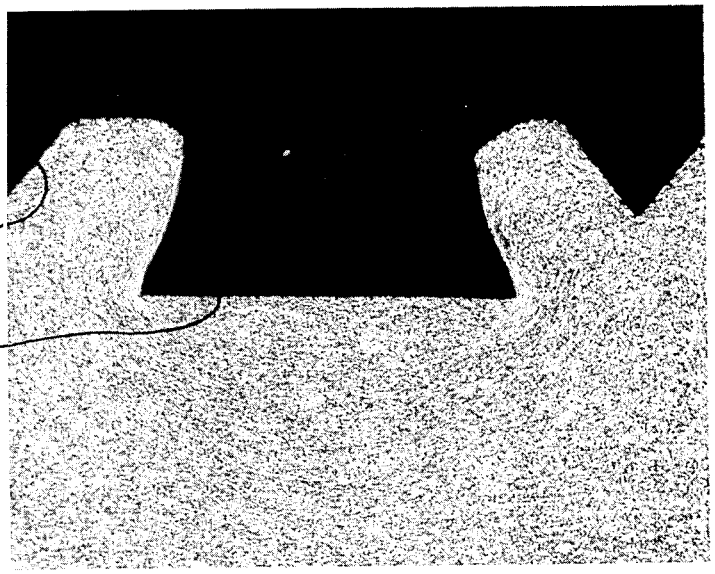

FIGS. 15–17 are actual photographs, similar to those of FIGS. 12–14, taken with 50-power magnification through a section of a commutator bar, etched and polished, and fabricated according to the invention. To facilitate the understanding, FIGS. 15–17 correspond to the rolling processes described by rollers 14*b*, 16*b* and 18*b* described in relation to FIGS. 9–11.

Specifically, it can be seen that preliminary groove 54 has been formed by roller 14*b* to a relatively shallow depth. The side walls of the groove are convergingly tapered, the bottom wall of the groove is substantially flat and the bottom corners are rounded. Full depth groove 66 (FIG. 10) then is rolled as indicated in FIG. 16. The full depth groove has a width substantially equal to at least the mouth of preliminary groove 54. This subsequent-pass groove forming step forms the desired pattern of grooves between adjacent ribs 44. To complete the rolling process, valleys 48 then are formed by roller 18*b* (FIG. 11) to form the completed dovetailed configuration and the final rib and groove pattern 24 as shown in detail in FIG. 8. It can be seen that, in actual practice, no fissures or "cracks" or other discontinuities whatsoever are formed at the bottom of full depth grooves 66 or final grooves 46 when fabricated according to the invention. In addition, consistent dovetailed configurations are formed by the forming of valleys 48 to split and spread the ribs, rather than a flattening process.

The process of the invention eliminates any fissures of other discontinuities in the commutator segments. These remarkable results come as a result of taking into account the high degree of material displacement and metallurgical changes encountered when rolling material, such as copper. For instance, when the edges of the ribbon or web are confined (as is done in actual practice), a 100 foot length of blank stock on reel 10 (FIG. 1) ends up rolled to a length on the order of 130 feet of rolled or formed stock on take-up reel 20. Further, copper material having a Rockwell hardness of 65–75 (on the "F" scale) for the blank stock ends in a roller or formed stock having a Rockwell hardness on the order of 90. This metal "reworking" is compensated for with the process of the invention. The process of the invention also provides consistent dovetailed configurations along the bonding ribs.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of fabricating an electric motor commutator shell having a predetermined rib and groove pattern on the inside surface thereof for anchoring to a molded insulating commutator core, comprising the steps of:

providing an elongated ribbon of electrically conductive material;

rolling a plurality of relatively shallow preliminary grooves to a depth significantly less than an intended full depth of the grooves, said preliminary grooves having a bottom wall and extending longitudinally on one side of the ribbon to partially displace the conductive material, the preliminary grooves having a given width;

rolling said preliminary grooves to the full depth to completely displace the material with a width substantially equal to said given width of the preliminary grooves to form said predetermined pattern of grooves between adjacent ribs whereby fissures or other discontinuities are substantially eliminated at the bottom of the full depth grooves;

severing a length of the rolled ribbon; and shaping the severed length into an annular form so that the rib and groove pattern is on the inside thereof for anchoring to a core of insulating material molded inside the annular form.

2. The method of claim 1 wherein said grooves are rolled into generally rectangular shapes having substantially flat bottom walls.

3. The method of claims 1 or 2 wherein said preliminary grooves are rolled to form generally convergingly tapered side walls thereof.

4. The method of claim 3 wherein the preliminary grooves are rolled to form rounded bottom corners thereof.

5. The method of claims 1 or 2, including the step of rolling the tops of the ribs with a set of valleys to form the ribs into dovetailed cross-sections overhanging adjacent grooves.

6. The method of claims 1 or 2, including forming a plurality of spaced upstanding ridges transversely spanning the bottom of each groove.

7. The method of claim 1, including the step of cutting a plurality of axial slots in the annular form after the core is molded on the inside thereof to provide a plurality of commutator segments.

8. A method of fabricating an electric motor commutator shell having a desired rib and groove pattern on the inside surface thereof for anchoring to a molded insulating commutator core, comprising the steps of:

providing an elongated ribbon of electrically conductive material;

passing the ribbon through a first set of rollers to form a plurality of longitudinal, relatively shallow preliminary grooves to a depth significantly less than an intended full depth of the grooves, said preliminary grooves having substantially flat bottom walls and a given width;

passing the ribbon through a subsequent set of rollers to form said preliminary grooves to the full depth, and a width substantially equal to the width of said bottom wall, to form said desired pattern of grooves between adjacent ribs whereby fissures or other discontinuities are substantially eliminated at the bottom of the full depth grooves;

severing a length of the roller ribbon; and shaping the severed length into an annular form so that the rib and groove pattern is on the inside thereof for anchoring to a core of insulating material molded inside the annular form.

9. The method of claim 8, including the step of passing the ribbon through a further set of rollers to form valleys in the tops of the ribs and to divide the ribs into dovetailed cross-sections overhanging adjacent grooves.

10. The method of claims 8 or 9, including forming a plurality of spaced upstanding ridges transversely spanning the bottom of each groove.

11. The method of claim 8, including the step of cutting a plurality of axial slots in the annular form after the core is molded on the inside thereof to provide a plurality of commutator segments.

* * * * *